US005998979A

United States Patent [19]

Nilsson

[11] Patent Number: 5,998,979

[45] Date of Patent: Dec. 7, 1999

[54] REGULATOR

[75] Inventor: Valter Nilsson, Hovås, Sweden

[73] Assignee: Telefonaktiebolaget LM Ericsson, Stockholm, Sweden

[21] Appl. No.: 09/179,660

[22] Filed: Oct. 27, 1998

[30] Foreign Application Priority Data

Oct. 28, 1997 [SE] Sweden ..... 9703921

[51] Int. Cl.[6] ..... G05F 1/40

[52] U.S. Cl. ..... 323/273

[58] Field of Search ..... 323/267, 273, 323/275, 280, 282, 285; 363/123, 125, 126, 127, 128, 81, 84

[56] References Cited

U.S. PATENT DOCUMENTS

| | | | |
|---|---|---|---|
| 5,510,697 | 4/1996 | Dormer | 323/273 |
| 5,528,127 | 6/1996 | Streit . | |
| 5,563,501 | 10/1996 | Chan | 323/282 |
| 5,625,278 | 4/1997 | Thiel et al. | 323/280 |
| 5,675,241 | 10/1997 | Teggatz et al. | 323/282 |
| 5,736,843 | 4/1998 | Amin | 323/273 |
| 5,815,382 | 9/1998 | Saint-Pierre et al. | 363/21 |
| 5,867,015 | 2/1999 | Corsi et al. | 323/316 |

FOREIGN PATENT DOCUMENTS

| | | |
|---|---|---|
| 0 428 377 | 5/1991 | European Pat. Off. . |
| 0 492 820 | 7/1992 | European Pat. Off. . |
| 0 648 007 | 4/1995 | European Pat. Off. . |
| 07087731 | 3/1995 | Japan . |
| 93/23906 | 11/1993 | WIPO . |
| 94/14231 | 6/1994 | WIPO . |

*Primary Examiner*—Adolf Deneke Berhane

*Attorney, Agent, or Firm*—Burns, Doane, Swecker & Mathis, L.L.P.

[57] ABSTRACT

A voltage regulator with a very low drop-out voltage. The regulator utilizes an inversely biased metal-oxid semiconductor field effect transistor as a regulating element. The field effect transistor is linearly controlled by an error amplifier which compares the regulated output with a reference voltage. The field effect transistor creates a voltage drop between the input and the regulated output by a diode function within the field effect transistor. The field effect transistor bypasses this diode function with a linearly controlled resistance function to thereby create a regulated output.

17 Claims, 3 Drawing Sheets

REGULATOR

This application claims priority under 35 U.S.C. §§119 and/or 365 to 9703921-8 filed in Sweden on Oct. 28, 1997; the entire content of which is hereby incorporated by reference.

BACKGROUND

The present invention relates generally to power supply circuits such as regulated AC/DC and DC/DC converters, especially voltage supply regulation and specifically the fine regulation of partially regulated voltage supplies.

Voltage converters in power supplies often have more than one output. To save space and money it is not unusual that power supplies with several outputs fine regulate one of the outputs and only coarsely or slave regulate the other outputs. A disadvantage with coarsely regulated or slave regulated outputs is that they inherently have an undesirable load dependence, i.e. the output varies in dependence of the load. The load dependence of each of these outputs is a compound dependence comprising the load and load variation of the output in question and a cross dependant part from the loads and load variations of the other outputs. The cross load dependence is primarily caused by the regulated output's load and load variations. Due to this the specified load ranges of such power supplies are rated very conservatively to ensure that the different voltages at the outputs are within acceptable levels at all times.

This puts very strict restrictions on the use of such power supplies. Such restrictions can be acceptable at the time of construction, if the power loads are of a nature that only vary within the rated load range restrictions of the power supply. There will, however, more likely than not, be a problem when a construction/apparatus is modernized since a modernization frequently will involve, or be the primary reason for, changing high power consuming parts with more up to date low power devices. A power supply that is optimized for higher loads can in such cases become completely obsolete if it cannot keep its outputs within specified limits at the new load or loads. It is highly undesirable to completely change an otherwise functional power supply. Therefore there exists a need to be able to extend the load range of existing power supplies having unregulated, coarsely regulated, and/or slave regulated outputs. Power supplies designed today also commonly have to be able to supply one or more voltages within fairly narrow limits over a very wide load range due to, for example, power save functions which can cause one or more parts of an apparatus to go from a very high power consumption to a very low or zero power consumption. This extension of or provision of a large load range should preferably be done in a cost effective manner, with a high efficiency and low additional losses, and require few, small, readily available, and cheap components as the available space can be quite restricted. The additional regulator or regulators that are needed should preferably also be rugged, be a complement to and not negatively influence any existing regulator or regulators, and not require any special or additional supply for their function.

There exists a multitude of different voltage regulators that can be used to regulate unregulated or coarsely regulated voltages. There are conventional series regulators and switched regulators just to mention a few. The disadvantages with conventional series regulators are that they have a relatively low efficiency and normally need some kind of overload protection. Switched regulators have a higher efficiency than conventional series regulators but they usually need more components such as magnetic components that are bulky and expensive and they usually also need overload protection of some kind. On top of that, switched regulators, due to high switching frequencies, can cause interference that is difficult to moderate.

Most conventional regulators have in common that a faulty component, i.e. the regulator is malfunctioning, can lead to an output voltage that is too high, i.e. harmful, or an output voltage that is nonexistent. Regulators can be constructed so that their outputs are protected from emitting harmful voltages, but this will generally, when the protection becomes active, lead to an unusable output or a completely unusable power supply instead.

SUMMARY

An object of the invention is to define a simple and cheap regulator which even in the event of total failure is able to deliver an unharmful and possibly still useful output.

Another object of the invention is to define a regulator which only requires a minimum number of components and which does not generate any or only very little interference during operation.

A further object of the invention is to define a regulator which is rugged and can easily be dimensioned so that no special load protection is required.

Still a further object of the invention is to define a regulator which can easily be added to an existing power supply by utilizing existing reference potentials and supply voltages for operation, to thereby improve the power supply's load range and regulation in a simple and cheap manner.

The above-mentioned objects are achieved in accordance with the invention by a voltage regulator with a very low drop-out voltage. The regulator utilizes an inversely biased metal-oxid semiconductor field effect transistor (MOSFET) as a regulating element/unit. The field effect transistor is linearly controlled by an error amplifier which compares the regulated output with a reference voltage. The field effect transistor creates a voltage drop between the input and the regulated output by a diode function within the field effect transistor. The field effect transistor bypasses this diode function with a linearly controlled resistance function to thereby create a regulated output.

The aforementioned objects are also achieved according to the invention by a voltage regulator comprising a reference terminal, an input terminal, an output terminal, a regulating unit, and a control unit. The input terminal is for connection of a voltage source between the input terminal and the reference terminal. The output terminal is for connection of a load between the output terminal and the reference terminal. The regulating unit comprises an input node, an output node and a regulator node. The regulating unit is coupled in series between the input terminal and the output terminal in such a way that the input node is coupled to the input terminal and the output node is coupled to the output terminal. The control unit comprises a reference node coupled to a predetermined reference voltage, a measuring node coupled to the output terminal, and a control node that is coupled to the regulator node of the regulating unit. The control unit creates an analog signal on the control node in dependence on the voltage difference between the reference node and the measuring node for control of the regulating unit in such a way that a predetermined voltage difference between the reference node and the measuring node is strived to be attained. According to the invention the regulating unit comprises a voltage drop unit coupled between the input node and the output node of the regulating unit. The voltage drop unit creates a voltage drop being smaller than the intended voltage of the voltage source. The voltage drop is substantially independent of the current through the voltage drop unit. Further according to the invention the regulating unit also comprises a substantially linearly controllable shunt unit. The shunt unit has the function of a substantially linearly variable resistance and is coupled between the input node and the output node of the regulating unit and having a control input coupled to the regulator node. The variable resistance varies its resistance in accordance with an analog signal applied to the control input to thereby bypass the voltage drop unit in such a way that the output terminal becomes voltage regulated.

The voltage drop unit can advantageously in some embodiments be one or more diodes coupled in series to thereby attain the desired voltage drop. The substantially linearly controllable shunt unit is preferably a field effect transistor. The field effect transistor can advantageously be of a metal-oxide semiconductor type which is inversely biased to thereby also create a diode function within the field effect transistor to act as the voltage drop unit.

The aforementioned objects are also achieved according to the invention by a power supply comprising at least two outputs. Of these outputs at least one output is regulated and at least one output is preregulated. According to the invention at least one of the at least one preregulated outputs is further regulated by means of a voltage regulator. The voltage regulator comprises an input terminal, an output terminal, a regulating unit, and a control unit. The input terminal is for connection of the preregulated output. The output terminal is for connection of a load. The a regulating unit comprises an input node, an output node and a regulator node. The regulating unit is coupled in series between the input terminal and the output terminal in such a way that the input node is coupled to the input terminal and the output node is coupled to the output terminal. The control unit comprises a reference node coupled to a predetermined reference voltage, a measuring node coupled to the output terminal, and a control node that is coupled to the regulator node of the regulating unit. The control unit creates an analog signal on the control node in dependence on the voltage difference between the reference node and the measuring node for control of the regulating unit in such a way that a predetermined voltage difference between the reference node and the measuring node is strived to be attained. According to the invention the regulating unit comprises a voltage drop unit coupled between the input node and the output node of the regulating unit. The voltage drop unit creates a voltage drop being smaller than the intended voltage of the preregulated output to which the input terminal is connected. The voltage drop is substantially independent of the current through the voltage drop unit. Further the regulating unit also comprises a substantially linearly controllable shunt unit having the function of a substantially linearly variable resistance. The shunt unit is coupled between the input node and the output node of the regulating unit and has a control input coupled to the regulator node. The variable resistance varies its resistance in accordance with an analog signal applied to the control input to thereby bypass the voltage drop unit in such a way that the output terminal becomes voltage regulated.

Advantageously the reference node of the control unit is coupled to one of the at least one regulated outputs. Preferably the voltage drop unit is at least one diode or diode function to thereby attain the desired voltage drop. Preferably the substantially linearly controllable shunt unit is a field effect transistor and more specifically the field effect transistor can be a metal-oxide semiconductor which is inversely biased which thereby also creates a diode function within the field effect transistor to act as the voltage drop unit.

The aforementioned objects are also achieved by a voltage regulator comprising a reference terminal, an input terminal, an output terminal, a regulating unit, and a control unit. The input terminal is for connection of a voltage source between the input terminal and the reference terminal. The output terminal is for connection of a load between the output terminal and the reference terminal. The regulating unit comprises an input node, an output node and a regulator node. The regulating unit is coupled in series between the input terminal and the output terminal in such a way that the input node is coupled to the input terminal and the output node is coupled to the output terminal. The control unit comprises a reference node coupled to a predetermined reference voltage, a measuring node coupled to the output terminal, and a control node that is coupled to the regulator node of the regulating unit. The control unit creates an analog signal on the control node in dependence on the voltage difference between the reference node and the measuring node for control of the regulating unit in such a way that a predetermined voltage difference between the reference node and the measuring node is strived to be attained. The regulating unit comprises an inversely biased metal-oxid semiconductor field effect transistor substantially functioning as a linearly variable resistance. The field effect transistor is coupled between the input node and the output node of the regulating unit and has a control input coupled to the regulator node. The field effect transistor also creates a voltage drop between the input node and the output node. The voltage drop is created by a diode function within the field effect transistor. The voltage drop is smaller than the intended voltage of the voltage source and substantially independent of the current being drawn at the output node. The field effect transistor varies its resistance in accordance with an analog signal applied to the control input to thereby bypass the voltage drop in such a way that the output terminal becomes voltage regulated.

By providing a simple regulator according to the invention, a plurality of advantages over prior art regulators are obtained. Due to its innovative design a very low drop-out voltage is attained. By providing a regulator with a very low drop-out voltage a very low dissipation is possible. Due to its simple design utilizing a field effekt transistor (FET) and the innovative use of the FET's inherent properties the regulator can be built cheaply with a limited number of low cost components and it will therefore be lightweight and occupy a small volume. The regulator according to the invention is inherently rugged and can easily be dimensioned so that no extra or special load protection is needed to safeguard the regulator. Since the regulator has a very limited dynamic control range this leads to no or only a very little need for supervision of the regulator itself. In comparison with switched regulators the regulator according to the invention does not induce any high frequency interference. Due to its simplicity, low cost, small weight and volume it is extremely simple and desirable to also apply to existing power supplies where a better regulation of one or more voltages needs to be applied.

BRIEF DESCRIPTION OF THE DRAWINGS

The invention will now be described in more detail for explanatory, and in no sense limiting, purposes, with reference to the following figures, in which.

DETAILED DESCRIPTION

In order to clarify the system according to the invention, some examples of its use will now be described in connection with FIGS. 1 to 6.

Figure 1:
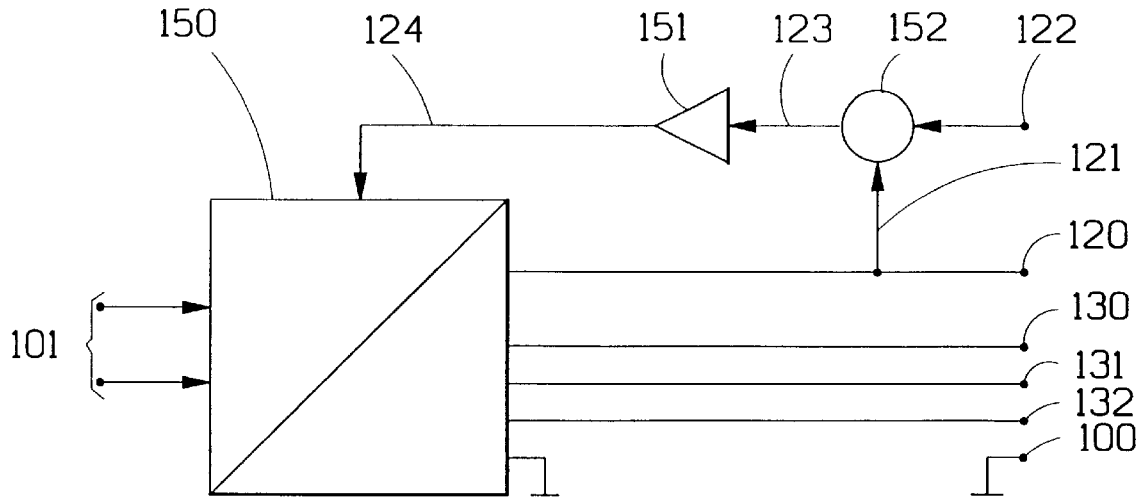
FIG. 1 shows a block diagram of a voltage regulator/converter where the invention advantageously can be implemented.

FIG. 1 shows a block diagram of a voltage regulator/converter 150 where the invention advantageously can be implemented. The power supply can either be of an AC to DC converter type or of a DC to DC converter type. What type of input power 101 the converter 150 requires is not important to the present invention. The converter 150 according to FIG. 1 provides one regulated output 120 and three unregulated, coarsely regulated, or slave regulated outputs 130, 131, 132 as well. A load, which in these circumstances preferably is a two terminal device, which is connected to any one of the outputs 120, 130, 131, 132 is usually also connected to a return line 100, commonly refered to as ground. To keep the regulated output 120 regulated a regulation feedback signal 121 is compared with a reference voltage signal 122 to thereby create an error signal 123, which is indicative of how much the output 120 deviates from the desired level. The error signal 123 is amplified in an amplifier 151 to create a sufficiently strong and/or large control signal 124 which is fed to the converter 150 for executing any necessary adjustment of the output level of the regulated output 120.

As mentioned previously the rated current levels of the regulated 120 as well as the coarsely or slave regulated outputs 130, 131, 132 are usually extremely restricted to thereby be able to rate the output voltages within usable levels. These restricted ratings, which not only have an upper limit, but also a lower limit, are due to among other things a cross load dependence between the outputs. The regulation and adjustment of the regulated output 120 also influences the other more or less unregulated outputs 130, 131, 132. This is usually not a desirable feature. This feature becomes even less desirable when the working conditions, the loads, of the power supply changes or if a power supply is to be constructed/designed which does not have restricted current ratings of the outputs in order to have output voltages within set limits.

Figure 2:
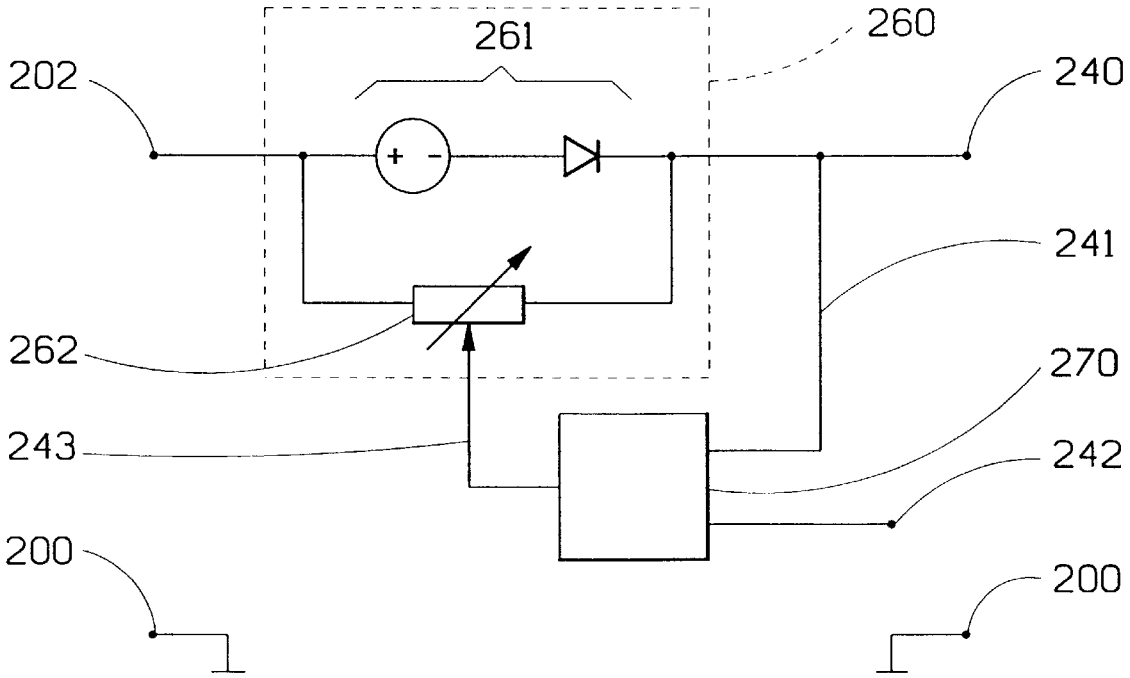
FIG. 2 shows a block diagram of a voltage regulator according to the invention.

FIG. 2 shows a block diagram of a voltage regulator according to the invention. The voltage regulator according to the invention basically comprises a control element/unit 270 and a regulating element/unit 260. Preferably a at least partially regulated power source is coupled to a power input 202 and a ground terminal 200, in this example it is assumed that there is a positive potential on the power input 202 in relation to the ground terminal 200. A desired load can be coupled to a regulated output 240 and the ground terminal 200. The regulating unit 260 comprising two pass elements 261, 262 is coupled in series between the unregulated input 202 and the regulated output 240.

According to the invention the regulating unit 260 comprises a voltage drop means 261 as a first pass element. The voltage drop means 261 is illustrated as an ideal battery opposing the voltage applied at the power input 202 and an ideal diode coupled in series with its cathode coupled to the regulated output 260. The regulating unit 260 also comprises a shunt 262 as a second pass element coupled parallell across the voltage drop means 261 and at the same time in series between the power input 202 and the regulated output 240. The shunt 262 is controllable on a control input by a continuously variable control signal 243 from the control unit 270. The analog control signal 243 is intended to control the shunt 262 in such a way that a balance is strived to be attained between a predetermined relationship of a reference voltage input 242 and a feedback signal 241 from the regulated output 260.

The voltage drop means 261 lowers the potential of the regulated output 240 a predetermined amount in comparison to the potential that exists at the power input 202. The predetermined voltage drop is less than the intended potential at the power input 202, i.e. the voltage drop should always be less than the voltage the regulator is designed to have as an input. The predetermined voltage drop is preferably designed to be the same or a bit greater than the maximum differential voltage that can arise between the power input 202 and the regulated output 240 when the regulator is operating within its ratings. The shunt 262 is controlled by the control unit 270 to bypass the voltage drop means 261 by an amount which is just enough to keep the potential at the regulated output 240 at a desired level. In practice this means that the predetermined voltage drop is set fairly small and the regulator is only adjusting the output in this limited dynamic range. Great advantages are attained by this limited dynamic range regulation. Even if a short circuit occurs in either pass element or even a break in either one the regulated output does not attain any harmful levels but most probably a level that is still usable.

The voltage drop means 261 can advantageously be one or more real diodes coupled in series as they will create a voltage drop relatively independent of the current passing. As an example a silicon diode will create a voltage drop of approximately 0.6 to 0.7 volts and a germanium diode will create a voltage drop in the region of 0.2 volts. The shunt 262 can advantageously be a field effect transistor which can be used as a controllable variable resistance. By using a field effect transistor inversely biased for linear control a parallell diod is attained which limits the maximum voltage that the regulator can sustain across it. A separate external voltage drop/diode is not necessary in these embodiments making the component count smaller.

Both positive and negative potentials can be regulated with either an N-channel or a P-channel MOSFET, preferably power MOSFETs. The only restrictions are that the direction of current should be from source to drain when using an N-channel FET and from drain to source when using a P-channel FET. However, it is advantageous to use an N-channel for the regulation of negative potentials and a P-channel for the regulation of positive potentials as no external voltage source is needed to drive the respective gate in these cases. This will result in simpler and thus cheaper regulators.

Figure 3:
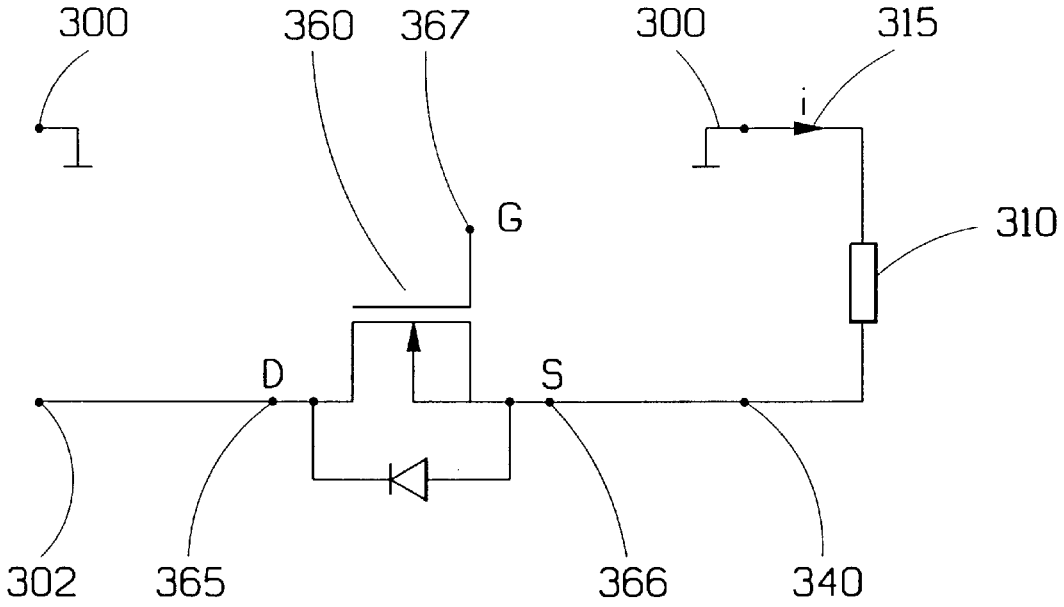
FIG. 3 shows an N-channel MOSFET coupled according to the invention regulating a negative supply.

FIG. 3 shows an N-channel MOSFET coupled according to the invention and regulating a negative supply. The unregulated input 302 has a negative potential in relation to ground 300. The unregulated input 302 is coupled to the drain 365, input node, of the MOSFET 360 and the source 366, output node, of the MOSFET 360 is coupled to the regulated output 340. The gate 367, regulator node, is coupled to a control element/unit which is not shown. Indicated in the figure is also the direction of current 315 through a load 310.

Figure 4:
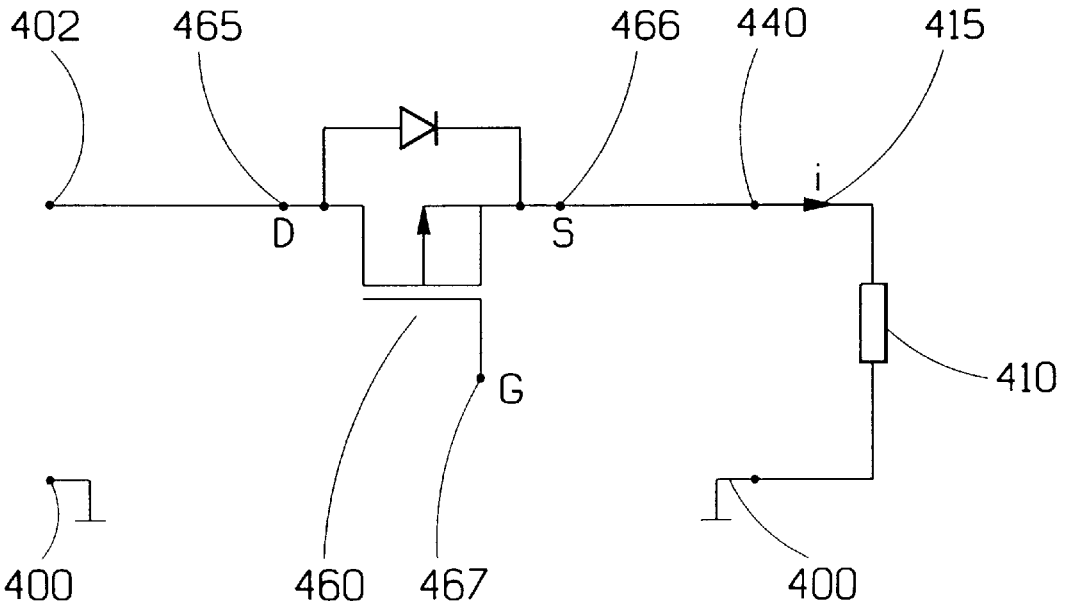
FIG. 4 shows a P-channel MOSFET coupled according to the invention regulating a positive supply.

FIG. 4 shows a P-channel MOSFET coupled according to the invention and regulating a positive supply. The unregulated input 402 has a positive potential in relation to ground 400. The unregulated input 402 is coupled to the drain 465, input node, of the MOSFET 460 and the source 466, output node, of the MOSFET 460 is coupled to the regulated output 440. The gate 467, regulator node, is coupled to a control element/unit which is not shown. Indicated in the figure is also the direction of current 415 through a load 410.

Figure 5:
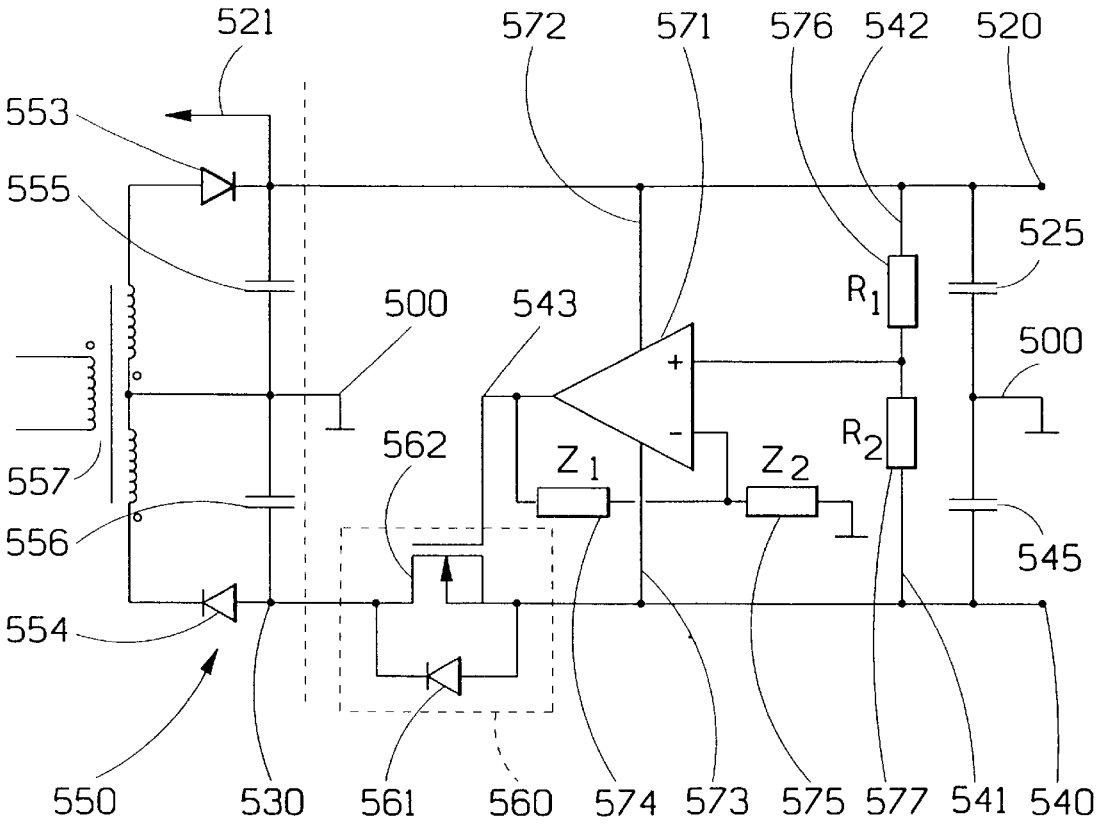
FIG. 5 shows an embodiment of the invention in a typical implementation.

FIG. 5 shows an embodiment of the invention in a typical implementation where the regulator according to the invention is added on to an existing construction. In this example the existing construction is a flyback switching power supply 550 with two outputs 520, 530, one positive output 520 which is regulated and one negative unregulated/slave regulated output 530. The existing construction 550 is only shown in part with a transformer 557, rectifying diodes 553, 554, output capacitors 555, 556, and a feedback signal 521 for regulation of the positive regulated output 520.

The low drop-out regulator according to the invention comprises an inversely biased field effect transistor 560 (FET), preferably a so called MOSFET as a regulating element/unit which comprises both pass elements, a diode 561 and a FET 562. To further minimize the number of additional components that the low drop-out regulator needs, its error amplifier 571 takes its supply power 572, 573 from the positive regulated output 520 and the regulated output 540 of the low drop-out regulator. To further optimize the construction the reference voltage 542 that the low drop-out regulator needs is taken from the positive regulated output 520. The example according to FIG. 5 takes advantage of the availability of a positive and a negative output. The optimal configuration of an error amplifier, its supply power and associated reference voltage will depend on the specific situation.

The reference voltage 542 and a feedback signal 541 from the output 540 of the low drop-out regulator is fed to the error amplifier 571 through a resistance divider comprising R1 576 and R2 577. The error amplifier 571 controls the MOSFET 560 by means of a control signal 543 in relation to the deviation of the feedback signal 541 from a desired level to thereby keep the regulated output regulated.

Z1 574 and Z2 575 belong to an impedance feedback network of the error amplifier 571. The feedback network is dimensioned to attain a proper frequency response of the regulator. A decoupling capacitor 525, 545 is preferably connected between each of the regulated outputs 520, 540 and ground 500.

Figure 6:
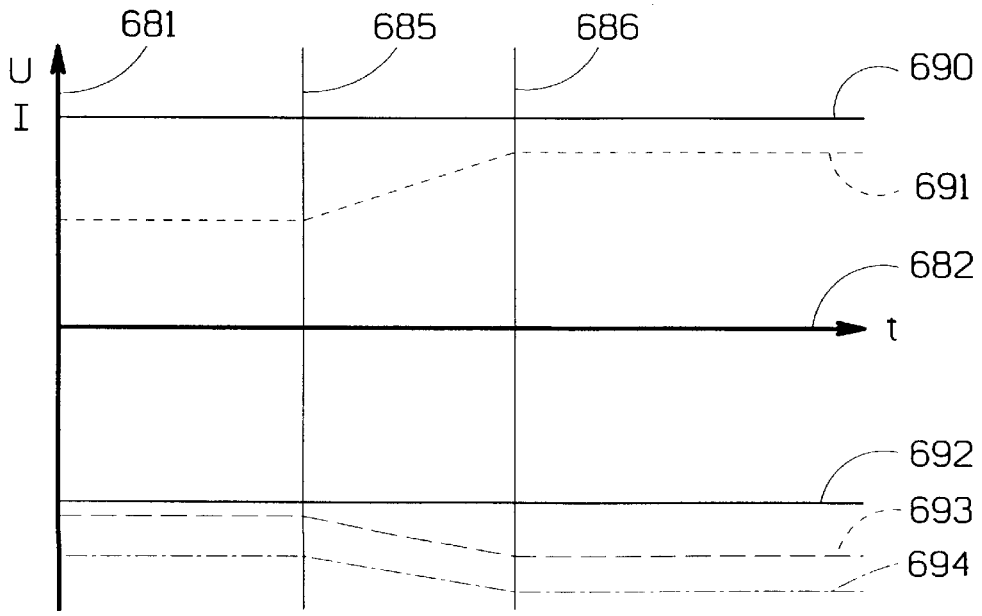
FIG. 6 shows a diagram of regulated and unregulated voltage outputs in relation to FIG. 1 and FIG. 5.

FIG. 6 shows a diagram of regulated and unregulated voltage outputs 690, 692, 693, 694 in relation to FIG. 1 and FIG. 5. The X-axis 682 depicts time while the Y-axis 681 depicts voltage and current levels. The diagram intends to show how cross load dependence effects regulated 690, unregulated/slave regulated 693, 694, and low drop-out regulated 692 outputs. The upper traces show the voltage 690 and current 691 drawn on a regulated output, for example the positive regulated output 520 of FIG. 5. At a first time 685 the current 691 starts to increase and does so until a second time 686 when the current drawn levels out at a higher level. As can be seen the voltage 690 of the regulated output does not vary, as it should not as long as the current 691 is within the rating of the regulator/power supply. The three bottom traces 692, 693, 694 show the voltage of a regulated output 692 according to the invention and two traces 693, 694 of an unregulated/slave regulated output, for example outputs 540 and 530 of FIG. 5 respectively. It is assumed that the load on these outputs are constant during each trace. The uppermost 692 of these three traces show how an output regulated with a low drop-out regulator according to the invention does not vary, not before or after the first 685 or the second 686 indicated times, i.e. there is no noticeable load dependence. The two bottom traces 693, 694 show, for example, a slave regulated output with different loads at the output in question. The slave regulated output can for example be one of the outputs 130, 131, 132 of FIG. 1 or the slave regulated output 530 of FIG. 5 without the low drop-out regulator. Independently of which, it is an output which is suitable for regulation according to the invention. The uppermost 693 of these traces show the voltage at this output when the output is loaded with its maximum rated output current. The trace 694 at the very bottom show the voltage at this output when the output is loaded with its minimum output current. It is clear from the difference in level between these two bottom traces 693, 694 that the output voltage at this output varies in dependence on the load on the output. It is also clear that the increase in load 691 at the regulated output 690 also effects the slave regulated output by increasing its output voltage.

As a summary, the invention can basically be described as low drop-out regulator utilizing an inversly biased MOSFET as a linear regulating element/unit.

The invention is not limited to the embodiments described above but may be varied within the scope of the appended patent claims.

What is claimed is:

1. A voltage regulator comprising a reference terminal, an input terminal for connection of a voltage source between the input terminal and the reference terminal, an output terminal for connection of a load between the output terminal and the reference terminal, a regulating unit comprising an input node, an output node, and a regulator node, the regulating unit is coupled in series between the input terminal and the output terminal in such a way that the input node is coupled to the input terminal and the output node is coupled to the output terminal, and the voltage regulator also comprises a control unit comprising a reference node coupled to a predetermined reference voltage, a measuring node coupled to the output terminal, and a control node that is coupled to the regulator node of the regulating unit, which control unit creates an analog signal on the control node in dependence on the voltage difference between the reference node and the measuring node for control of the regulating unit to attain a predetermined voltage difference between the reference node and the measuring node, wherein the regulating unit comprises a voltage drop unit coupled between the input node and the output node of the regulating unit which voltage drop unit creates a voltage drop being smaller than the intended voltage of the voltage source, and being substantially independent of the current through the voltage drop unit, and the regulating unit also comprises a substantially linearly controllable shunt unit having the function of a substantially linearly variable resistance and being coupled between the input node and the output node of the regulating unit and having a control input coupled to the regulator node, which variable resistance varies its resistance in accordance with an analog signal applied to the control input to thereby bypass the voltage drop unit in such a way that the output terminal becomes voltage regulated.

2. The voltage regulator according to claim 1, wherein the voltage drop unit comprises one or more diodes coupled in series to thereby attain the desired voltage drop.

3. The voltage regulator according to claim 2, wherein the substantially linearly controllable shunt unit comprises a field effect transistor.

4. The voltage regulator according to claim 3, wherein the field effect transistor comprises a metal-oxide semiconductor which is inversely biased which thereby also creates a diode function within the field effect transistor to act as the voltage drop unit.

5. The voltage regulator according to claim 1, wherein the substantially linearly controllable shunt unit comprises a field effect transistor.

6. The voltage regulator according to claim 5, wherein the field effect transistor comprises a metal-oxide semiconductor which is inversely biased which thereby also creates a diode function within the field effect transistor to act as the voltage drop unit.

7. A power supply comprising at least two outputs of which at least one output is regulated and at least one output is preregulated, where at least one of the at least one preregulated outputs is further regulated by means of a voltage regulator comprising an input terminal for connection of the preregulated output, an output terminal for connection of a load, a regulating unit comprising an input node, an output node, and a regulator node the regulating unit being coupled in series between the input terminal and the output terminal in such a way that the input node is coupled to the input terminal and the output node is coupled to the output terminal, and the voltage regulator also comprising a control unit comprising a reference node coupled to a predetermined reference voltage, a measuring node coupled to the output terminal, and a control node that is coupled to the regulator node of the regulating unit, which control unit creates an analog signal on the control node in dependence on the voltage difference between the reference node and the measuring node for control of the regulating unit to attain a predetermined voltage difference between the reference node and the measuring node, wherein the regulating unit comprises a voltage drop unit coupled between the input node and the output node of the regulating unit which voltage drop unit creates a voltage drop being smaller than the intended voltage of the preregulated output, and being substantially independent of the current through the voltage drop unit, and the regulating unit also comprises a substantially linearly controllable shunt unit having the function of a substantially linearly variable resistance and being coupled between the input node and the output node of the regulating unit and having a control input coupled to the regulator node, which variable resistance varies its resistance in accordance with an analog signal applied to the control input to thereby bypass the voltage drop unit in such a way that the output terminal becomes voltage regulated.

8. The power supply according to claim 7, wherein the reference node of the control unit is coupled to one of the at least one regulated outputs.

9. The power supply according to claim 8, wherein the voltage drop unit comprises at least one diode coupled in series to thereby attain the desired voltage drop.

10. The power supply according to claim 9, wherein the substantially linearly controllable shunt unit comprises a field effect transistor.

11. The power supply according to claim 10, wherein the field effect transistor comprises a metal-oxide semiconductor which is inversely biased which thereby also creates a diode function within the field effect transistor to act as the voltage drop unit.

12. The power supply according to claim 7, wherein the voltage drop unit comprises at least one diode coupled in series to thereby attain the desired voltage drop.

13. The power supply according to claim 12, wherein the substantially linearly controllable shunt unit comprises a field effect transistor.

14. The power supply according to claim 13, wherein the field effect transistor comprises a metal-oxide semiconductor which is inversely biased which thereby also creates a diode function within the field effect transistor to act as the voltage drop unit.

15. The power supply according to claim 7, wherein the substantially linearly controllable shunt unit comprises a field effect transistor.

16. The power supply according to claim 15, wherein the field effect transistor comprises a metal-oxide semiconductor which is inversely biased which thereby also creates a diode function within the field effect transistor to act as the voltage drop unit.

17. A voltage regulator comprising a reference terminal, an input terminal for connection of a voltage source between the input terminal and the reference terminal, an output terminal for connection of a load between the output terminal and the reference terminal, a regulating unit comprising an input node, an output node, and a regulator node, the regulating unit being coupled in series between the input terminal and the output terminal in such a way that the input node is coupled to the input terminal and the output node is coupled to the output terminal, and the voltage regulator also comprising a control unit comprising a reference node coupled to a predetermined reference voltage, a measuring node coupled to the output terminal, and a control node that is coupled to the regulator node of the regulating unit, which control unit creates an analog signal on the control node in dependence on the voltage difference between the reference node and the measuring node for control of the regulating unit to attain a predetermined voltage difference between the reference node and the measuring node, wherein the regulating unit comprises an inversely biased metal-oxid semiconductor field effect transistor substantially functioning as a linearly variable resistance and being coupled between the input node and the output node of the regulating unit and having a control input coupled to the regulator node, which field effect transistor also creates a voltage drop between the input node and the output node, the voltage drop being created by a diode function within the field effect transistor and being smaller than the intended voltage of the voltage source and substantially independent of the current being drawn at the output node, which field effect transistor varies its resistance in accordance with an analog signal applied to the control input to thereby bypass the voltage drop in such a way that the output terminal becomes voltage regulated.

* * * * *